US005332159A

United States Patent [19]

Grime et al.

[11] Patent Number: 5,332,159

[45] Date of Patent: Jul. 26, 1994

[54] SPRAY GUN WITH DUAL MODE TRIGGER

[75] Inventors: Thomas E. Grime, Temperance, Mich.; James P. Baltz, Waterville, Ohio; Roger T. Cedoz, Curtice, Ohio; John F. Schaupp, Toledo, Ohio

[73] Assignee: Ransburg Corporation, Indianapolis, Ind.

[21] Appl. No.: 48,277

[22] Filed: Apr. 14, 1993

Related U.S. Application Data

[63] Continuation-in-part of Ser. No. 894,730, May 27, 1992, Pat. No. 5,236,129.

[51] Int. Cl.[5] ..... B05B 7/02

[52] U.S. Cl. ..... 239/412; 239/414; 239/526

[58] Field of Search ..... 239/525-528, 239/583, 414, 415, 412

[56] References Cited

U.S. PATENT DOCUMENTS 1,643,969 10/1927 Tittemore et al. ..... 239/526
1,906,975 5/1933 Larson ..... 239/527
3,836,082 9/1974 Krohn ..... 239/526

FOREIGN PATENT DOCUMENTS 887013 12/1981 U.S.S.R. ..... 239/526

*Primary Examiner*—Karen B. Merritt
*Attorney, Agent, or Firm*—MacMillan, Sobanski & Todd

[57] ABSTRACT

A paint spray gun having a dual operating mode trigger. The trigger pivots on a gun body about an axis. The two operating modes are selected by radially positioning the trigger relative to the axis. In a first operating mode, fluid flow to a nozzle is gradually increased as the trigger is gradually squeezed to permit fluid flow control for feathering the applied coating. In this mode, the trigger is mechanically linked for actuating a valve needle. In a second operating mode, a small actuating movement of the trigger operates a valve which causes a piston to move the valve needle to its fully open position. The second operating mode provides only on-off fluid control with a very short trigger stoke and a low trigger force.

17 Claims, 7 Drawing Sheets

SPRAY GUN WITH DUAL MODE TRIGGER

CROSS REFERENCE TO RELATED APPLICATION

This is a continuation-in-part of copending U.S. patent application Ser. No. 07/894,730 filed May 27, 1992, now U.S. Pat. No. 5,236,129.

TECHNICAL FIELD

The invention relates to paint spray guns and more particularly to a hand held paint spray gun in which the trigger has two operating modes for turning the gun on and off.

BACKGROUND ART

Many jobs require the use of hand held paint spray guns. These include certain jobs in manufacturing and jobs in automotive refinishing shops, for example. When an operator is required to frequently use a spray gun over a long period of time, the operator may develop fatigue in the hand and wrist. Fatigue can be aggravated by repetitive motions, such as by frequently squeezing the spray gun trigger with the same finger motion, by unbalanced forces on the hand and wrist, by the weight of the gun and by the force required to operate the gun trigger.

A typical prior art hand held paint spray gun includes a gun body having a nozzle assembly mounted on one end and having a handle depending from adjacent an opposite end. A trigger is attached to the gun body to pivot towards and away from the handle. When an operator holds the gun by the handle and squeezes the trigger, an air valve is opened and then a valve needle is moved to open a fluid valve. The air valve supplies any air required for atomization and for shaping the spray pattern. If the trigger is only partially squeezed, the fluid valve may be only partially opened to permit the operator to apply a lighter coating, for example, for feathering when touching up a coating. The spray gun also includes an adjustable stop which limits either trigger travel or the valve needle travel to adjust the maximum paint flow from the gun when the trigger is fully squeezed. In the prior art hand held spray gun, the trigger has a relatively long travel. Consequently, the operators fingers must move the trigger over a relatively large arc when squeezing or releasing the trigger. Also, a relatively high force has been required to overcome friction when squeezing the trigger and to assure that the gun turns off when the trigger is released.

DISCLOSURE OF INVENTION

The invention is directed to a hand held paint spray gun which reduces stress on the fingers and hand of an operator. The spray gun has a gun body, a nozzle assembly and a handle, as in prior art guns. According to the invention, a trigger mounted on the gun body has two different operating modes. The trigger is moved in a radial direction towards and away from a pivot axis to select between the two operating modes. In a first operating mode, the trigger is squeezed to move over a predetermined arc in operating the gun. When the trigger is partially squeezed, the paint flow is reduced to permit feathering of the applied coating. Movement of the trigger is connected through mechanical linkages to move a valve needle. Friction on the valve needle is minimized to minimize the required trigger force.

When the trigger is positioned for the second mode, the trigger stroke is greatly reduced. In this position, the mechanical linkage to the valve needle is disengaged. Trigger movement over an arc significantly smaller than the predetermined arc for the first mode operates a pneumatic valve assembly to cause the valve needle to be opened. The pneumatic valve assembly has a low operating force to reduce potential finger and hand fatigue. In the second operating mode, the spray gun is either fully on or fully off.

Accordingly, it is an object of the invention to provide an improved hand held paint spray gun having a trigger with dual operating modes.

Other objects and advantages of the invention will become apparent from the following detailed description of the invention and the accompanying drawings.

BEST MODE FOR CARRYING OUT THE INVENTION

Figure 1:
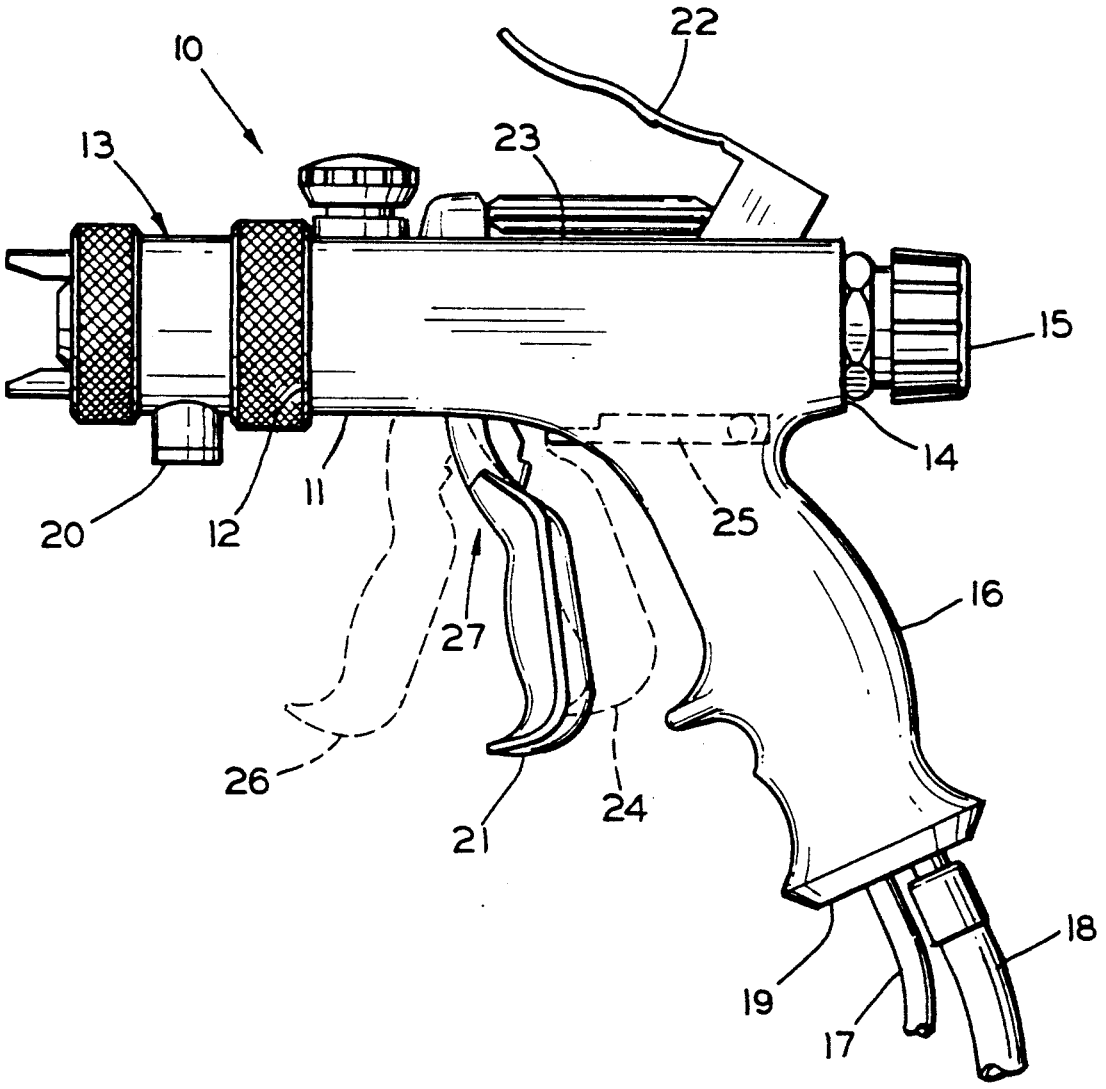
FIG. 1 is a left side elevational view of a paint spray gun according to the invention.

Turning now to FIG. 1 of the drawings, a hand held paint spray gun 10 is illustrated in accordance with a preferred embodiment of the invention. The spray gun 10 generally includes a body 11 having a front end 12 to which a fluid nozzle assembly 13 is secured and having a rear end 14. A knob 15 is secured to the rear body end 14 for adjusting the maximum flow of paint from the gun 10. A handle 16 depends from the body 11 adjacent the rear end 14. A fluid hose 17 and a compressed air hose 18 are shown secured to a lower free end 19 of the handle 16. However, it will be appreciated that the fluid hose 17 and the air hose 18 may be secured to the rear body end 14 or that the fluid hose 17 can be secured to a fitting 20 on the nozzle assembly 13 and supported from the handle end 19. The spray gun 10 is shown as having a main trigger 21 and an optional auxiliary trigger 22. The main trigger 21 is mounted to pivot towards and away from the handle 16 and the auxiliary trigger is mounted to pivot towards and away from a top 23 of the gun body 11.

As will be described in greater detail below and is shown in detail in the other figures, the main trigger 21 has two distinct operating modes. When the trigger 21 is positioned in the first operating mode as shown in solid and an operator gradually squeezes the trigger 21, a mechanical linkage mounted on the gun body 11 gradually opens a valve needle to provide an increasing flow of fluid to the nozzle assembly 13. For the second operating mode, the trigger 21 is pushed radially upwardly towards its pivot point on the gun body 11 and is moved towards the handle 16 to the position shown by the dashed lines 24. When the trigger 21 is subsequently moved a short distance towards the handle 16, the trigger 21 engages and moves a push bar 25 to open a valve in the gun body. Opening the valve causes a piston to be pneumatically moved to turn the spray gun 10 fully on. When the trigger 21 is released, the spray gun 10 is turned off. Optionally, the trigger 21 may be pivoted forward to the position shown by the dashed line 26. When the trigger is in the forward position, an area 27 between the trigger 21 and the handle 16 is opened up to permit the operator to grasp the gun body 11 in the area 27 for using the auxiliary trigger 22. The auxiliary trigger 22 is particularly useful when the spray gun 10 is aimed downwardly for painting generally horizontal surfaces.

Figure 2:
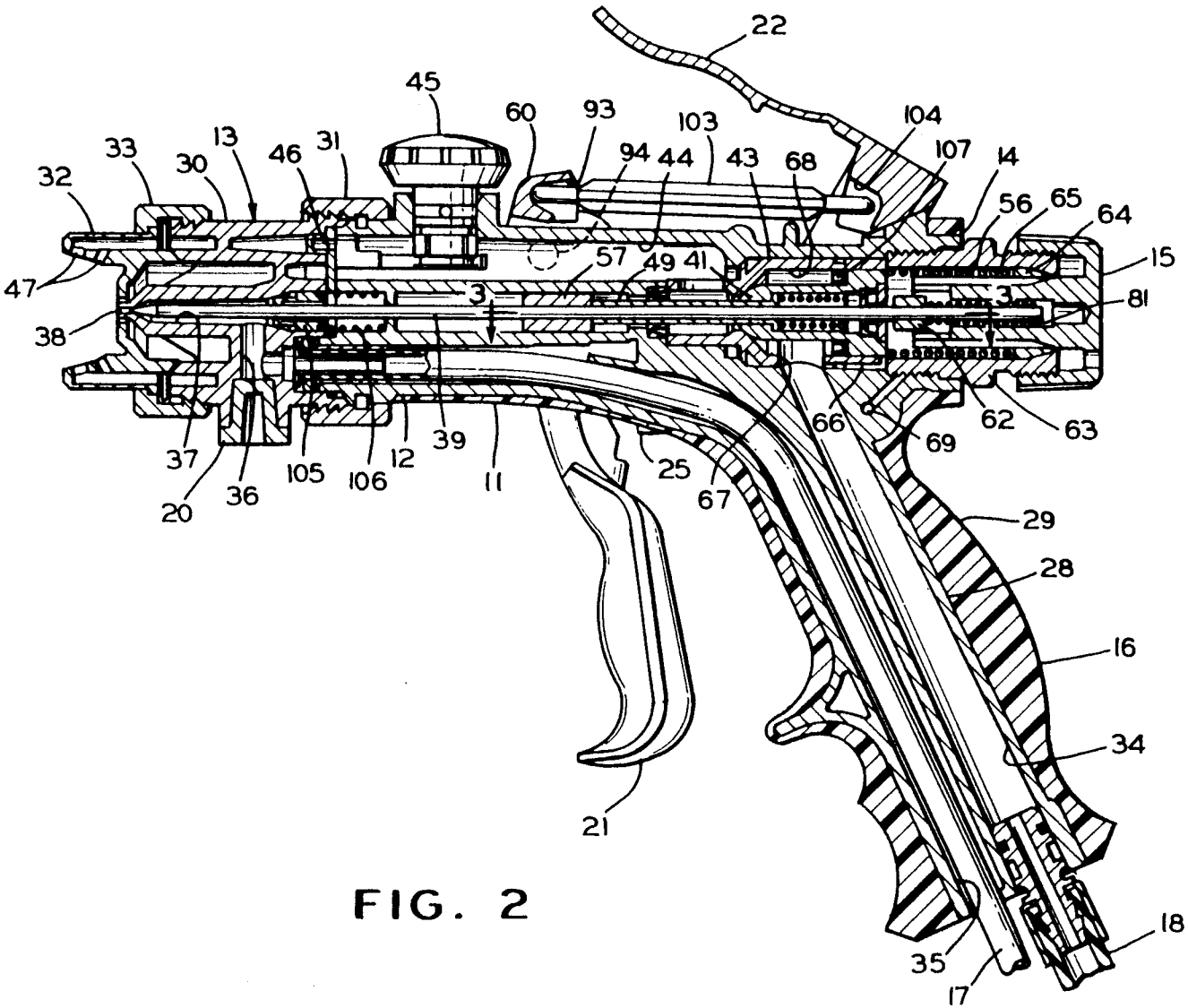
FIG. 2 is a is an enlarged vertical cross sectional view throughout the center of the paint spray gun of FIG. 1.

Details of the spray gun 10 are shown in the cross sectional view of FIG. 2. A molded plastic skeleton 28 and an outer cover 29 form the gun body 11 and the handle 16 as an integral unit. The nozzle assembly 13 consists of a spray head 30 secured to the front body end 12 by a head retaining ring 31 and an air cap 32 secured to the spray head 30 by a retaining ring 33. The air hose 18 is connected to a passageway 34 in the handle 16. The fluid hose 17 passes through a passageway 35 in the skeleton 28 and connects to a passage 36 in the spray head 30. The passage 36 connects with a chamber 37 which leads to a fluid discharge orifice 38. Normally, a valve needle 39 is seated in the spray head 30 to close the orifice 38. The valve needle 39 extends axially through the gun body 11 to the knob 15.

Figure 3:
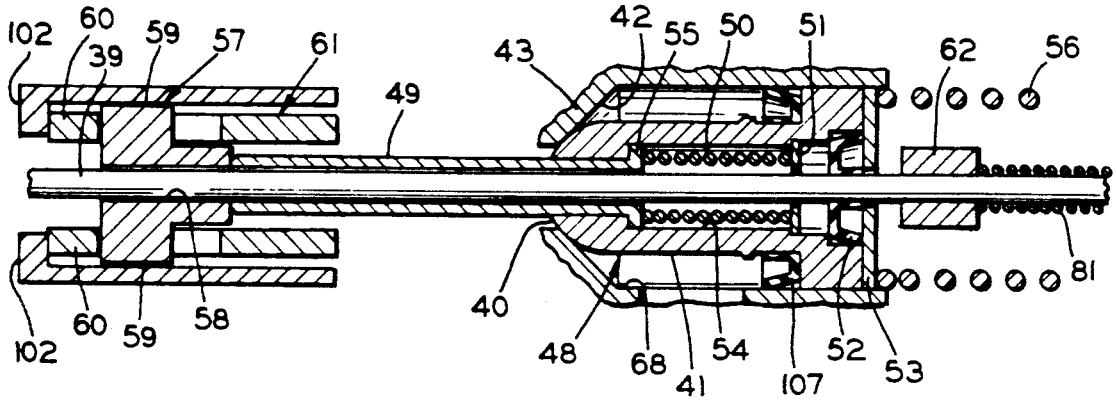
FIG. 3 is an enlarged fragmentary cross sectional view taken along line 3–3 of FIG. 2 showing a portion of the mechanical linkage for moving the valve needle in a first operating mode.

Pressurized air is delivered to the handle passageway 34 from the air hose 18. As shown in FIGS. 2 and 3, a front surface 40 on a piston 41 is normally seated against a surface 42 on an air valve bushing 43 to block the flow of air to a passageway 44 in the gun body 11. The passageway 44 is connected for delivering atomization air and pattern shaping air to the spray head 30 and thence to the air cap 32. A knob 45 on the gun body 11 controls a pattern shaping air valve 46 to control the discharge of such air from pattern shaping orifices 47 on the air cap 32.

As best shown in FIG. 3, the piston 41 is part of a piston assembly 48 which includes an air valve stem 49, a compression spring 50, a retainer ring 51, a valve needle seal 52 and a plate 53. The piston 41 has a stepped axial bore 54. The air valve stem 49 is generally tubular and slides in an axial direction in the piston bore 54. An enlarged diameter end flange 55 retains the air valve stem 49 in the bore 54. The retainer ring 51 is an internal retainer ring which engages the piston bore 54. The compression spring 50 is compressed between the air valve stem flange 55 and the retainer ring 51. The seal 52 preferably has a U-shaped cross section and forms a low friction sliding seal between the piston 41 and the valve needle 39 which extends axially through the piston assembly 48. The seal 52 is retained by the plate 53. A compression spring 56 presses against the plate 53 to cause the piston surface 40 to seat against the surface 42.

A T-block 57 is positioned to slide in an axial direction on the valve needle 39 forward of the air valve stem 49. The T-block 57 has an opening 58 through which the valve needle 39 passes and has two radially directed lugs 59. Side portions 60 on an actuator arm 61 are moved to engage the lugs 59 for in turn moving the valve needle 39 to turn on the spray gun 10 when it is operated in a first mode. As will be discussed in further detail below, squeezing either the trigger 21 or the auxiliary trigger 22 rotates the actuator arm 61 to urge the T-block 57 towards the rear end 14 of the gun body 11. This pushes on the air valve stem 49, moving the piston surface 40 clear of the surface 42 on the air valve bushing 43. Air then flows between the surfaces 40 and 42 to the passageway 44 and is discharged from the nozzle assembly 13 for atomizing fluid and for shaping the pattern of the atomized fluid in a known manner.

As the T-block 57 moves the piston assembly 48 further back, the plate 53 contacts a collar 62 which is secured to the valve needle 39. Further movement of the piston assembly 48 causes the valve needle 39 to move and pressurized fluid from the fluid hose 17 is discharged from the orifice 38 and atomized. The spacing between the piston assembly 48 and the collar 62 when the spray gun 10 is off assures that the flow of atomization and pattern shaping air will start prior to the discharge of fluid from the orifice 38. The amount of fluid discharged will depend on various factors, such as the fluid pressure, the size of the orifice 38, the distance that the valve needle 39 is moved and the properties of the fluid. A rear plug 63 is secured to the rear body end 14 and the knob 15 is threaded into the rear plug 63. The knob 15 forms an adjustable stop against which the collar 62 abuts when the fluid valve is fully opened. Rotating the knob 15 adjusts the maximum travel of the valve needle 39 when the fluid valve is opened. An annular seal 64 fits between the knob 15 and the rear plug 63. The spring 56 extends between the plate 53 and the seal 64. The spring 56 functions both as a return spring for the piston assembly 48 and as a spring for maintaining a force on the seal 64 to form a self adjusting air tight seal between the rear plug 63 and the knob 15.

Figure 4:
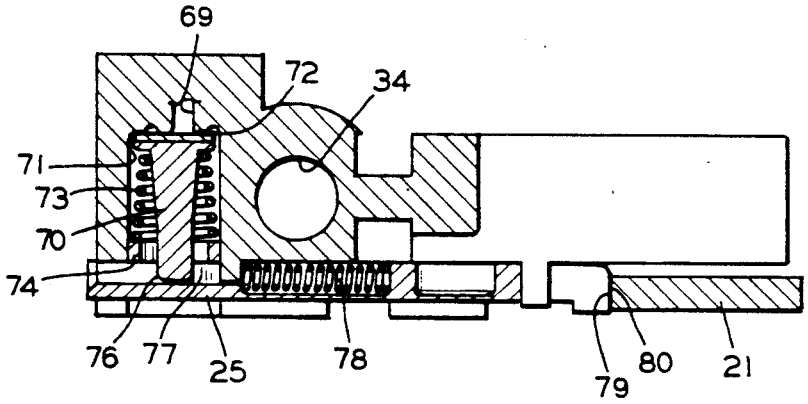
FIG. 4 is a cross sectional view through a trigger actuated valve for operating the spray gun in a second mode, with the valve shown closed.
Figure 5:
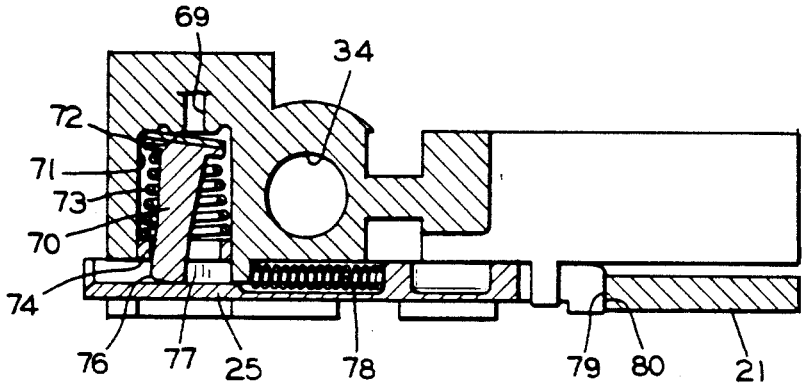
FIG. 5 is a cross sectional view through the trigger actuated valve, similar to FIG. 4, but with the valve shown open.

The spring 56 is located in a chamber 65. A small passage 66 in the air valve bushing 43 connects the chamber 65 to the handle passage 34 to allow a limited flow of the pressurized air into the chamber 65. A much larger opening 67 in the air valve bushing 43 also allows the pressurized air to flow from the handle passage 34 into a chamber 68 formed between the air valve bushing 43 and the piston 41. Thus, air pressure is normally balanced on both sides of the piston 41 and the piston 41 does not present an impediment to axial movement of the piston assembly 48 when the spray gun 10 is turned on or off by movement of either of the triggers 21 or 22. The rear chamber 65 is connected through a passage 69 to a normally closed valve 70 (FIGS. 4 and 5). As will be discussed in greater detail below, when the spray gun 10 is in the second operating mode and the trigger 21 is squeezed, the valve 70 opens and the chamber 65 is vented to atmosphere, establishing an air pressure differential across the piston 41. The air pressure differential is sufficient to move the piston rearwardly until the collar 62 abuts the knob 15 and the valve needle 39 is fully opened.

FIGS. 4 and 5 show details of the valve 70. The passage 69 connects to a chamber 71 in the skeleton 28. An annular ridge 72 surrounds the passage 69 to form a seat for the valve 70. A compression spring 73 is compressed between the valve 70 and a retainer ring 74 to urge the valve 70 to seal against the ridge 72, closing the passage 69. A push bar 25 is secured to the skeleton 28 to slide in an axial direction. An end 76 on the valve 70 is engaged by a bumper 77 on the push bar 25. A compression spring 78 urges the push bar 25 to the position shown in FIG. 4 wherein the push bar 25 does not affect closure of the valve 70. When the trigger 21 is positioned for the second operating mode and is squeezed, a surface 79 on the trigger 21 engages and moves a free end 80 of the push bar 25, thus causing the valve 70 to tilt off of the ridge or seat 72, as shown in FIG. 5. When this occurs, the passage 69 is vented through the chamber 71 to atmosphere to in turn vent the chamber 65 (FIG. 2). When the chamber 65 is vented, the air pressure differential across the piston 41 moves the piston 41 against the force of the return spring 56 to cause the spray gun 10 to be turned fully on. When the trigger 21 is released and the valve 70 is again closed, the pressure in the chamber 65 will become equalized with the pressure in the chamber 68 and the spring 56 and a valve needle return spring 81 shut off the spray gun 10.

Figure 6:
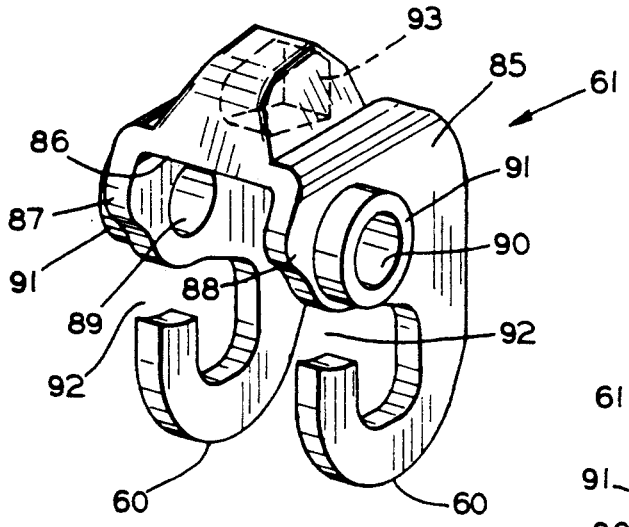
FIG. 6 is a perspective view showing details of the actuator arm which moves the valve needle.

Details for the mechanism for mechanically operating the spray gun 10 when either of the triggers 21 or 22 is squeezed are shown in FIGS. 2, 3, 6 and 7. As shown in FIG. 6, the actuator arm 61 has a generally U-shaped body 85. The body 85 consists of an upper portion 86 from which two sides 87 and 88 depend. The sides 87 and 88 are spaced to straddle the skeleton 28. Aligned openings 89 and 90 extend through the sides 87 and 88, respectively and a tubular portion 91 extends outwardly from each side 87 and 88 around the opening 89 or 90. Each side 87 and 88 is shaped into a lower hooked shaped side portion 60 which terminates at a gap 92. Finally, a rearwardly opening recess 93 is formed in the upper portion 86, as best seen in the cross section of FIG. 2.

Figure 7:
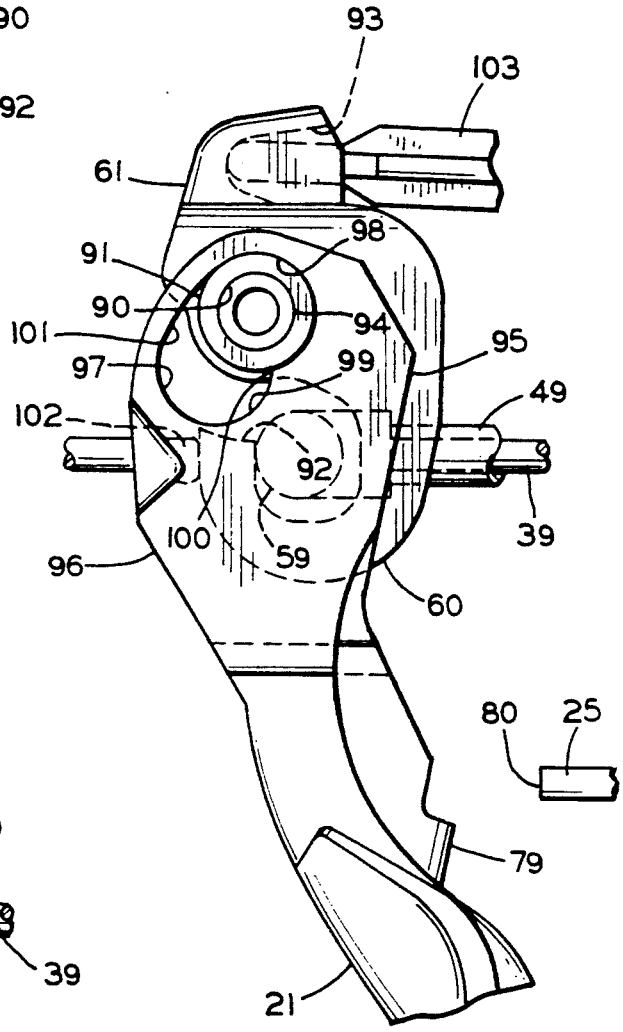
FIG. 7 is a fragmentary left side view showing details of the trigger, the actuator arm and the valve needle assembly, with the trigger positioned for operating the spray gun in the first mode.
Figure 8:
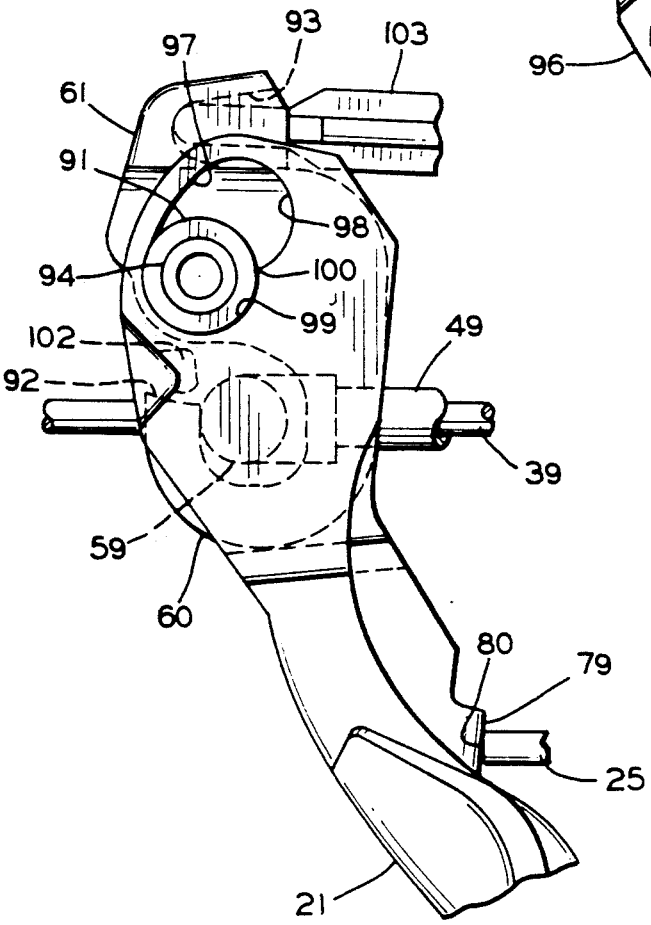
FIG. 8 is a fragmentary left side view, similar to FIG. 7, but with the trigger positioned for operating the spray gun in the second mode.

Two aligned pins 94 are integrally formed on opposite sides of the skeleton 28 for mounting the actuator arm 61 and the trigger 21 (one of the pins 94 is shown in FIG. 7). The actuator arm 61 is positioned to straddle the skeleton 28 with one of the pins 94 located in each opening 89 and 90 so that the actuator arm 61 can pivot on the gun body 11. The trigger 21 has a U-shaped upper portion 95 with two parallel sides 96 which similarly straddle the actuator arm 61. The two sides 96 have aligned openings 97 which engage the projections 91 on sides 87 and 88 of the actuator arm 61. The openings 97 are formed with two overlapping lobes 98 and 99 with a small apex 100 on one side opposite a smoothly curved side 101. The shape of the openings 97 permits the trigger 21 to be in a first position wherein the opening lobes 98 pivot on the projections 91 when the spray gun is in a first operating mode, as shown in FIG. 7. The trigger 21 may be pushed upwardly until the projections 91 snap into the second lobe 99 to engage a second operating mode for the spray gun 10, as shown in FIG. 8. Or, the trigger 21 may be pulled downwardly to reengage the first operating mode.

Figure 9:
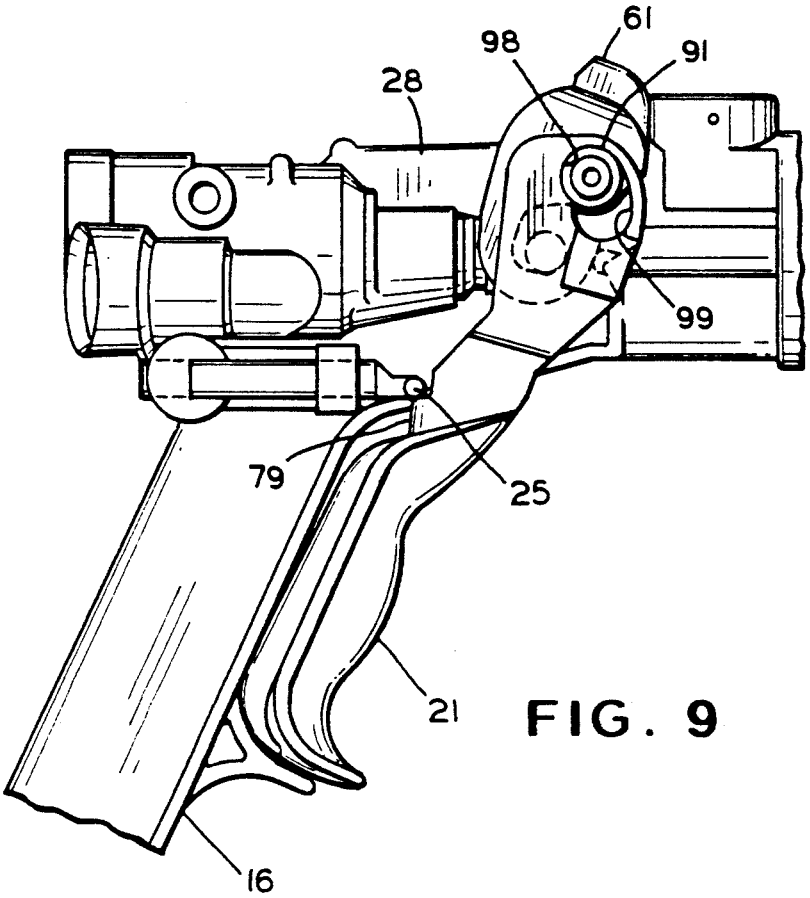
FIG. 9 is a fragmentary side elevational view of the spray gun with its cover removed showing the trigger squeezed while in the first operating mode.

When the trigger 21 is positioned for the first operating mode, inwardly directed tabs 102 on the trigger sides 96 abut the sides 60 of the actuator arm 61, as shown in FIGS. 3 and 7. When the trigger 21 is squeezed, the tabs 102 push on and pivot the actuator arm 61. The lugs 59 on the T-block 57 are confined within the curved actuator arm sides 60. Consequently, when the actuator arm 61 pivots due to squeezing the trigger 21, the T-block 57 is pushed towards the rear of the spray gun 10. This in turn pushes on the air valve stem 49 to move the piston 41 for initiating air flow to the nozzle assembly 13 and to move the valve needle 39 to initiate fluid discharge from the nozzle assembly 13. As shown in FIGS. 7 and 9, the surface 79 on the trigger 21 is spaced to clear the push bar 25 so that the valve 70 is not actuated when the trigger 21 is squeezed while in the first operating mode.

A push rod 103 extends between the recess 93 on the top of the actuator arm 61 and a recess 104 on the auxiliary trigger 22 (FIG. 2). When the auxiliary trigger 22 is squeezed or pivoted towards the gun body 11, the push rod 103 is moved towards the front of the spray gun 10 to pivot the actuator arm 61. Consequently, either of the triggers 21 or 22 is capable of pivoting the actuator arm 61 for turning on the spray gun 10. The amount of fluid discharged from the spray gun 10 will depend upon how far either trigger 21 or 22 is squeezed when the spray gun is in the first operating mode.

Figure 10:
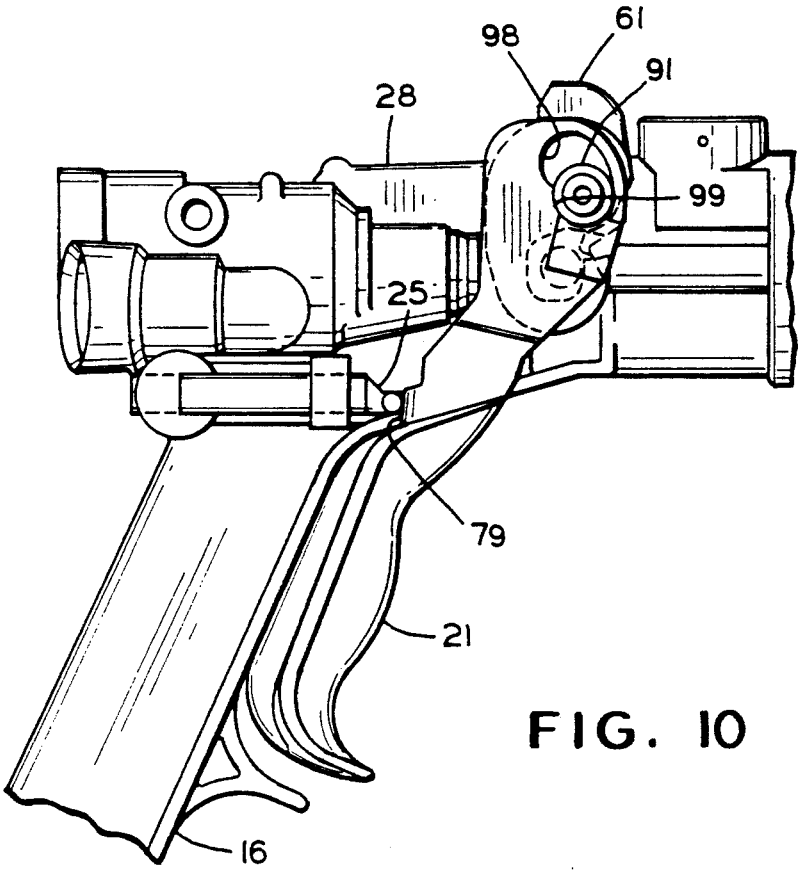
FIG. 10 is a fragmentary side elevational view, similar to FIG. 9, but showing the trigger squeezed while in the second operating mode.

FIG. 8 is a fragmentary view showing details of the operation of the trigger 21 when positioned in the second operating mode. The trigger 21 is pushed upwardly until the actuator arm projections 91 snap into the hole lobes 99 on the trigger sides 96. When the trigger 21 is in this position, the tabs 102 have the same radial spacing from the axis of the pins 94 and the projections 91 as the gaps 92 on the sides 60 of the actuator arm 61. Consequently, when the trigger 21 is squeezed towards the gun handle 16 (FIGS. 1 and 2), the tabs 102 move into the gaps 92 and the actuator arm 61 is not pivoted to actuate the spray gun 10. However, when the trigger 21 is positioned as shown in FIG. 8 and squeezed, the trigger surface 79 contacts the push bar surface 80 and moves the push bar 25 for opening the valve 70, as shown in FIGS. 8 and 10. Consequently, the spray gun 10 will be turned fully on by the resulting movement of the piston 41. When the main trigger 21 is positioned in the second operating mode, the auxiliary trigger 22 is still functional for operating the spray gun 10.

The trigger 21 has no separate return spring. When positioned in the first operating mode as shown in FIG. 7, the spring 56 pushes the piston 41 to its normally closed position when the trigger 21 is released. The force of the spring 56 through the piston 41, the air valve stem 49, the T-block 57 and the actuator arm 61 pivots the trigger 21 to its released position. The trigger 21 is held in this position by friction. When the trigger 21 is positioned in the second operating mode as shown in FIG. 8, the spring 78 moves the push bar 25 to its normal position when the trigger 21 is released. The force of the spring 78 also pivots the trigger to its released position. Since the push bar 25 only moves a short distance when the trigger is squeezed to actuate the gun 10, the released trigger will be returned only a short distance. Consequently, the trigger 21 will be positioned close to the handle 16 and only require a short movement to turn on the spray gun 10 when operated in the second mode and only requires an operating force to overcome friction and the force of the springs 78 and 73.

Figure 11:
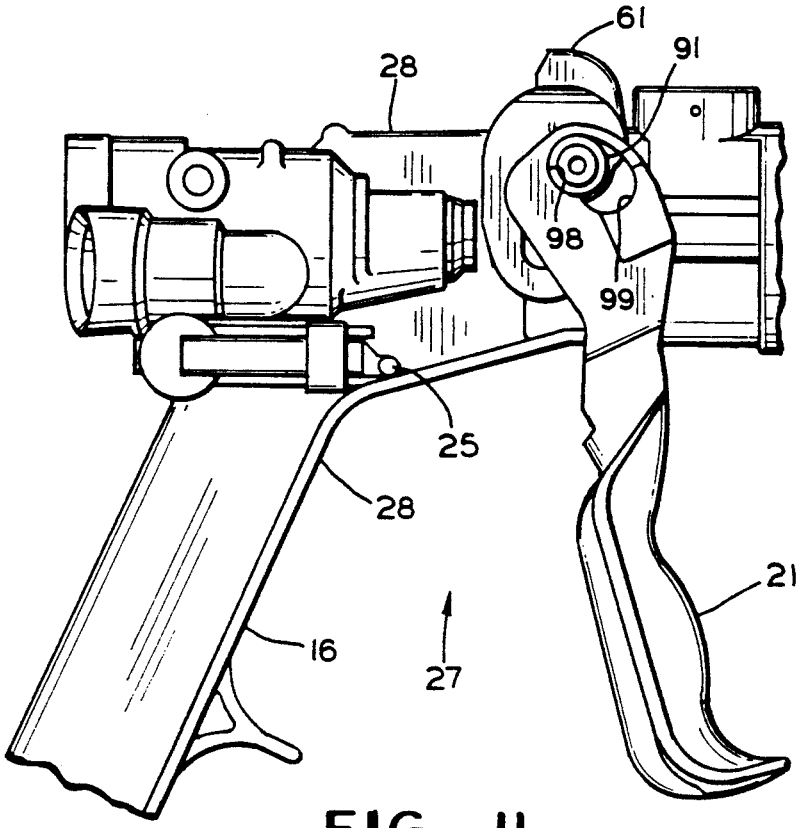
FIG. 11 is a fragmentary side elevational view, similar to FIG. 9, but showing the trigger in the first operating mode and positioned forward to facilitate using an auxiliary trigger.
Figure 12:
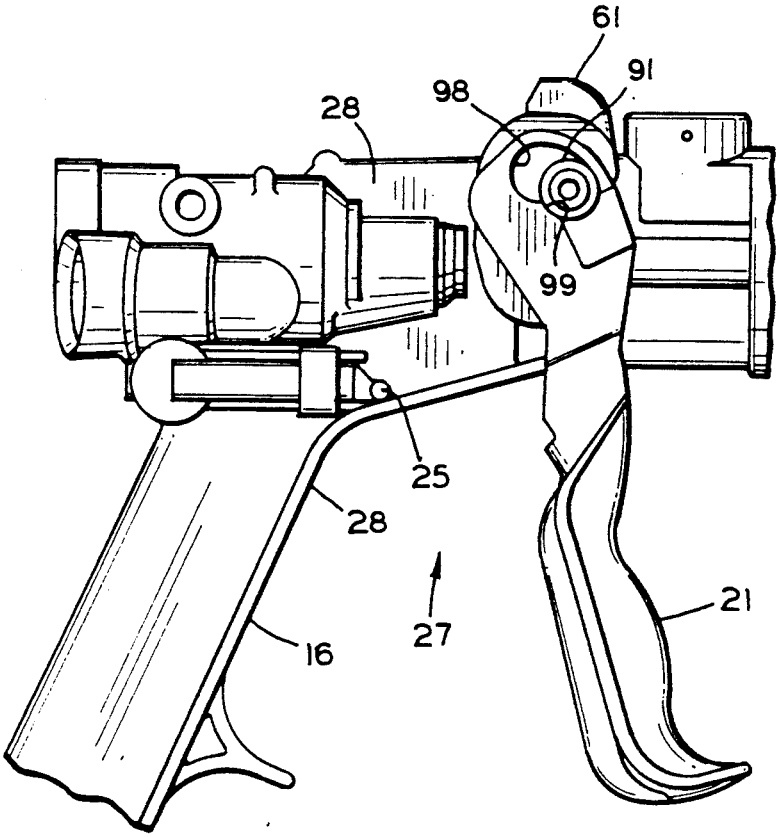
FIG. 12 is a fragmentary side elevational view, similar to FIG. 10, but showing the trigger in the second operating mode and positioned forward to facilitate using the auxiliary trigger.

FIGS. 11 and 12 show a fragmentary portion of the spray gun 10 with the trigger 21 pivoted forward away from the handle 16 to open the area 27 between the handle 16 and the trigger 21. FIG. 11 shows the trigger 21 positioned for the first operating mode and moved forward and FIG. 12 shows the trigger 21 positioned for the second operating mode and moved forward. The trigger 21 is held in the forward position by friction or by a suitable detent (not shown). When the trigger 21 is in the forward position, the spray gun body 11 is easily grasped between the handle 16 and the trigger 21 to facilitate using the auxiliary trigger 22, for example, when aiming the gun 10 downward to spray a horizontal surface.

Various techniques are used in the spray gun 10 for minimizing the force and the length of the stroke or arc required to operate the trigger 21 in the first operating mode. Very low trigger force is required for the second operating mode since only a low force is required to operate the valve 70. It has been found that the trigger operating force is affected by various factors. Reducing the diameter of the valve needle 39 to a smaller diameter than used in prior art spray gun valve needles reduces the drag area and polishing the valve needle 39 reduces packing friction. Preferably, the valve needle 39 has a diameter $\leqq 0.1$ inch ($\leqq 2.54$ mm) at least at the seals to reduce friction. Further, at the seals the valve needle 39 should be polished to an average surface roughness of $\leqq 15$ micro inch ($\leqq 0.0000254$ mm). The use of a polytetrafluoroethylene (Teflon) packing 105 which is loaded by a spring 106 (FIG. 2) reduces friction and automatically adjusts the packing 105 to control packing tightness and to control drag. The design of the trigger provides a mechanical advantage of about 7:1, while maintaining ergonomic trigger travel and form. The air valve formed between the piston surface 40 and the air valve bushing surface 42 has a surface contour which allows full air flow with a shorter trigger travel. Preferably, the air valve is constructed to open at a rate which gives a ratio of square inches of flow area per inch of travel for the piston $\geqq 0.65$ (419 $mm^2$ of air flow area per 25.4 mm of piston travel), which is 3 times greater than a typical prior art trigger operated air atomization paint spray gun.

Figure 13:
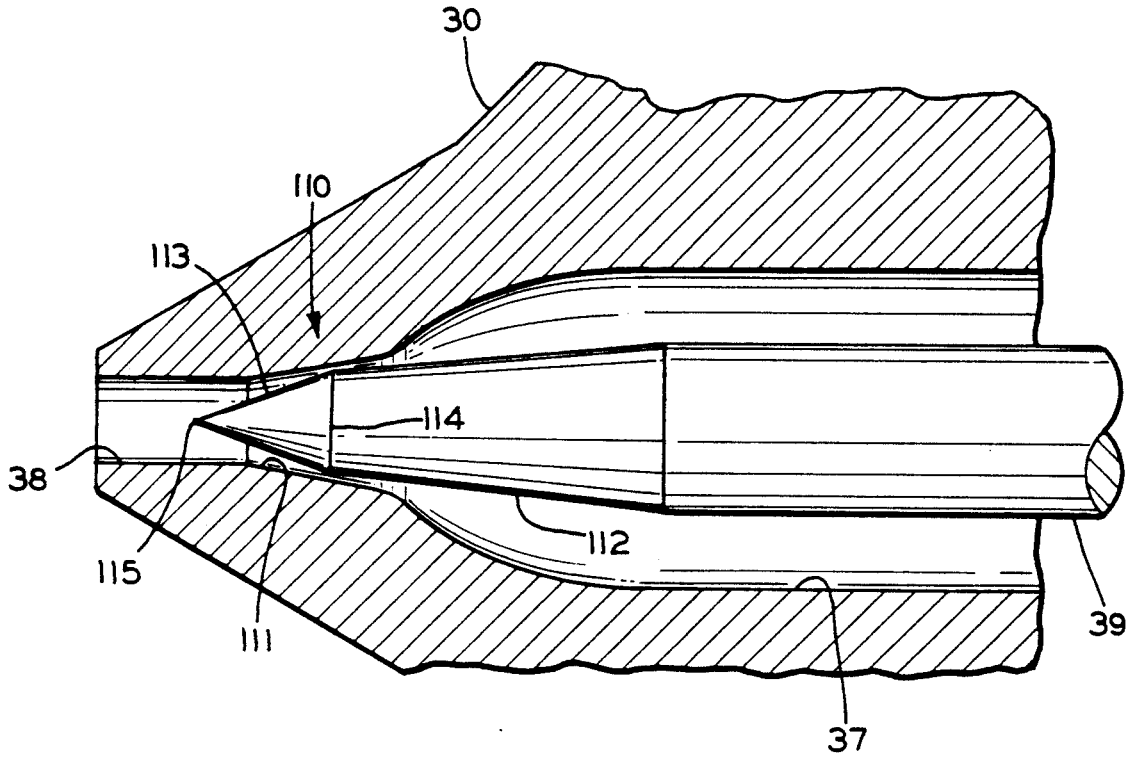
FIG. 13 is an enlarged cross sectional view showing details of the fluid valve.

The contour of the end of the valve needle 39 which seats in the spray head 30 also provides quick opening of the fluid valve while maintaining consistent feathering control of fluid flow in the first operating mode. FIG. 13 shows details of the contours for a preferred design for fluid valve 110. At a forward end of the fluid chamber 37 in the fluid head 30, the chamber is curved with blend radii to a conic section 111 which connects to a straight section leading to the fluid discharge orifice 38. The conic section 111 is in the form of a frustum of a right circular cone having slightly tapered side walls. The valve needle 39 has at its forward end, a first conic section 112 which connects with a second, forward section 113. The first conic section 112 is in the form of a frustum of a right circular cone having sides tapered at an angle less than the sides of the fluid head section 111. Preferably, the spray head conic section 111 is tapered to have an included vertex angle of about 20° and the valve needle conic section 112 is tapered to have an included vertex angle of about 12°. The valve needle sections 112 and 113 join at an annulus 114 which is of a diameter to seat against a central region of the spray head section 111. The forward valve needle section 113 is a cone terminating at a vertex 115. Preferably, the section 113 has a vertex angle of about 40°. The forward sections 112 and 113 of the valve needle 39 may be formed of a low friction material to minimize friction when the annulus 114 is withdrawn from the spray head section 111 during triggering.

Finally, low friction seals 52 and 107 (FIGS. 2 and 3) which have U-shaped cross sections are used to reduce drag forces between the valve needle 39 and the piston 41 and between the piston 41 and the air valve bushing 43, respectively. The spray gun 10 may be constructed to require an actuating force no greater than 2 pounds (0.9 Kg.) to actuate the gun 10 in the first operating mode and an actuating force no greater than 1 pound (0.45 Kg.) when operating the gun in the second operating mode. Preferably, the trigger 21 pivots over an arc of at least 10° when operated in the first mode to permit accurate control of feathering and the trigger 21 pivots over an arc of less than 10° and preferably no greater than 5° when operated in the second mode.

It will be appreciated that various modifications and changes may be made to the above described preferred embodiment of a hand held spray gun without departing from the spirit and the scope of the following claims.

We claim:

1. A hand held liquid spray gun including a gun body having first and second ends, a liquid atomization nozzle assembly secured to said first end, a handle extending from adjacent said second end for holding said spray gun, and a main trigger for controlling the discharge of liquid from said spray gun, said spray gun being characterized by said trigger having first and second operating modes, first means responsive to trigger movement for varying the amount of liquid discharged from said spray gun as a function of trigger movement between fully off and a predetermined maximum liquid flow when said trigger is in said first operating mode, and second means responsive to a predetermined small trigger movement when said trigger is in said second operating mode for controlling the flow of liquid discharged from said spray gun between fully off and said predetermined maximum liquid flow, and wherein said trigger is moveable over a greater range of movement in said first operating mode than in said second operating mode.

2. A hand held liquid spray gun, as set forth in claim 1, and including means mounting said trigger on said gun body to pivot towards and away from said handle, and wherein said trigger pivots over a range of at least 10° when said trigger is operated in said first mode, and wherein said trigger pivots over a range of less than 10° when said trigger is operated in said second mode.

3. A hand held liquid spray gun, as set forth in claim 2, and wherein said trigger pivots over a range of no greater than 5° when said trigger is operated in said second mode.

4. A hand held liquid spray gun, as set forth in claim 1, and wherein said trigger requires an operating force of no greater than 0.9 Kg. in said first operating mode and requires an operating force of no greater than 0.45 Kg. in said second operating mode.

5. A hand held liquid spray gun, as set forth in claim 1, and further including means mounting said trigger on said body to pivot towards and away from said handle, wherein said trigger has a first position relative to a pivot point on said gun body when in said first operating move, and said trigger has a second position relative to said pivot point when in said second operating mode.

6. A hand held liquid spray gun, as set forth in claim 5, wherein said trigger is moveable in a generally radially direction relative to said pivot point between said first and second positions, and including means for retaining said trigger in a selected one of said first and second positions.

7. A hand held liquid spray gun, as set forth in claim 1, and further including adjustment means for simultaneously setting the maximum liquid discharge rate from said spray gun in said first operating mode and the liquid discharge rate from said spray gun in said second operating mode.

8. A hand held liquid spray gun including a gun body having first and second ends, a liquid atomization nozzle assembly secured to said first end, a handle extending from adjacent said second end for holding said spray gun, and a main trigger for controlling the discharge of liquid from said spray gun, said spray gun being characterized by said trigger having first and second operating modes, first means responsive to trigger movement for varying the amount of liquid discharged from said spray gun as a function of trigger movement when said trigger is in said first operating mode, second means responsive to a predetermined small trigger movement when said trigger is in said second operating mode for turning fully on and off the flow of liquid discharged from said spray gun, valve needle means mounted in said gun body for controlling the discharge of liquid from said spray gun, mechanical linkage means for moving said valve needle means in response to movement of said trigger when said trigger is in said first operating mode, piston means for moving said valve needle means between open and closed positions, and valve means for causing said piston means to move said valve needle means to said open position when said trigger is in said second operating mode and squeezed.

9. A hand held liquid spray gun, as set forth in claim 8, and further including means mounting said trigger on said body to pivot towards and away from said handle, wherein said trigger has a first position relative to a pivot point on said gun body when in said first operating move, and said trigger has a second position relative to said pivot point when in said second operating mode.

10. A hand held liquid spray gun, as set forth in claim 9, wherein said trigger is moveable in a generally radially direction relative to said pivot point between said first and second positions, and including means for retaining said trigger in a selected one of said first and second positions.

11. A hand held liquid spray gun, as set forth in claim 9, and including means on said trigger for engaging said mechanical linkage to control said spray gun when said trigger is in said first position, and means on said trigger for operating said valve means to control said spray gun when said trigger is in said second position.

12. A hand held liquid spray gun, as set forth in 8, and wherein said piston means includes an integral air valve for controlling a flow of atomization and pattern shaping air to said nozzle assembly, said piston means moving between a first position wherein said air valve is closed and a second position, said air valve opening to provide a flow of atomization and pattern shaping air when said piston is moved to an intermediate position between said first and second positions, and a return spring urging said piston towards said first position.

13. A hand held liquid spray gun, as set forth in claim 13, and further including means on said piston for engaging said valve needle means when said piston has moved to said intermediate position, and wherein said piston moves said valve needle means to said open position when said piston is moved from said intermediate position to said second position.

14. A hand held liquid spray gun, as set forth in claim 13, wherein said mechanical linkage means includes an actuator arm mounted on said spray gun body to rotate between first and second positions, and means for moving said piston from said first piston position to said second piston position when said actuator arm is rotated from said first actuator arm position to said second actuator arm position.

15. A hand held liquid spray gun, as set forth in claim 14, and wherein said trigger means includes means operable only when said trigger is in said first operating mode for rotating said actuator arm from said first actuator arm position progressively towards said second actuator arm position as said trigger means is progressively squeezed.

16. A hand held liquid spray gun, as set forth in claim 15, wherein said handle depends from a bottom of said gun body, and further including an auxiliary trigger mounted on said gun body to pivot towards and away from a top of said gun body, and means for rotating said actuator arm from said first actuator arm position progressively towards said second actuator arm position as said auxiliary trigger is progressively pivoted towards said gun body top.

17. A hand held liquid spray gun, as set forth in claim 16, and including means mounting said main trigger on said gun body to pivot towards and away from said handle, said main trigger pivoting over a predetermined arc when said spray gun is operated by said main trigger in said first operating mode, and wherein said main trigger is pivotal away from said handle over an arc greater than said predetermined arc to facilitate grasping said gun body between said handle and said main trigger when using said auxiliary trigger.

* * * * *